United States Patent [19]

Whyte et al.

[11] 4,065,376

[45] Dec. 27, 1977

[54] ELECTROLYTIC CELL

[75] Inventors: Andrew Whyte; William A. Gallup, both of Painesville; Barry A. Schenker, Mayfield Heights; Robert A. Schulz, Euclid, all of Ohio

[73] Assignee: Diamond Shamrock Corporation, Cleveland, Ohio

[21] Appl. No.: 683,027

[22] Filed: May 4, 1976

[51] Int. Cl.[2] ..... C25B 9/00; C25B 13/00; C25B 15/08

[52] U.S. Cl. ..... 204/263; 204/275; 204/296

[58] Field of Search ..... 204/257, 263–266, 204/253–256, 275, 296

[56] References Cited

U.S. PATENT DOCUMENTS

| | | | |
|---|---|---|---|
| 2,543,059 | 2/1951 | Rawles | 204/257 |
| 2,872,406 | 2/1959 | Buchanan | 204/257 X |
| 3,657,099 | 4/1972 | Seko et al. | 204/253 |
| 3,864,236 | 2/1975 | Lindstrom | 204/256 |

FOREIGN PATENT DOCUMENTS

| | | | |
|---|---|---|---|
| 976,111 | 10/1975 | Canada | 204/253 |

*Primary Examiner*—John H. Mack
*Assistant Examiner*—D. R. Valentine
*Attorney, Agent, or Firm*—Bruce M. Winchell

[57] ABSTRACT

Disclosed is an electrolytic cell utilizing an electrolyte circulation system designed to prevent buildup of sludge within the cell compartments and to insure a greater current efficiency by reason of the even distribution of electrolyte solution flow within the cell. This electrolytic cell is particularly suited for organic electrochemical production.

6 Claims, 4 Drawing Figures

ELECTROLYTIC CELL

BACKGROUND OF THE INVENTION

The present invention relates generally to an electrolytic cell which is capable of electrochemical production particularly organic electrochemical production, having an electrolyte circulation system designed to prevent sludge buildup within the electrolytic cell compartments. More particularly the present disclosure relates to an improved circulation system for use particularly in a cathode compartment to promote the even flow and distribution of the catholyte along the cathode surface and a jetting action as to reduce sludge buildup within the cathode compartment. Such a system could also readily be used in the anode compartment of an electrolytic cell when an anodic reaction is the desired production reaction to be performed. In every electrolytic cell there will be simultaneously an anodic and a cathode reaction but often only one of these is the desired reaction for electrochemical production. Henceforth, a named reaction is the electrochemical production reaction. In the present invention, the cathode compartment is used for organic electrochemical production of the type for which this particular cell is especially useful. The electrolytic cell itself is a component system made up of more or less planar sections such as an end plate, a cathode, a cathode compartment frame, an anode with an anode compartment frame, a planar separator and a second end plate which are pressed together in sealing engagement with gasketing between the sections to produce an electrolytic cell.

Electrochemical methods of manufacture are becoming ever increasingly important to the chemical industry due to their greater ecological acceptability, potential for energy conservation and the resultant cost reductions possible. Some of the reasons advanced for this possible shift in future chemical production and especially organic chemical production are that electrolytic cells can be generally operated as a closed system, thereby allowing greater control over the escape of by-products or waste products from the electrolytic cell in organic chemical production. Also many fuels are rapidly rising in price thus making electricity a more economical power source for many types of production. This is causing a shift from a great dependence upon fossil fuels such as coal, gas, and oil to the use of electricity which may be more economical in the future due to more nuclear generation. The electrolytic cell promises to be one of the most efficient means of utilizing electricity for the production of many organic compounds as it has been in the past for the production of chlorine and caustic (sodium hydroxide). Since a great deal of the current chlorine and caustic needs are produced in electrolytic cells, much knowhow used in such production can be utilized and transferred over to organic electrochemical production. This may result in electrolytic production methods replacing some of the old thermal processes which are currently in use. Therefore a great deal of research and development effort is being applied to organic electrochemical processes and the hardware for these processes.

With the advent of technological advances such as the dimensionally stable anode and various coating compositions therefor which permit ever narrowing gaps between the electrodes, the electrolytic cell has become more efficient in that the current efficiency is greatly enhanced by the use of these electrodes. Also the hydraulically impermeable membrane has added a great deal to the use of electrolytic cells in terms of the selective migration of various ions across the membrane surface so as to exclude contaminants from the resultant product thereby eliminating some costly purification or concentration second steps of processing.

There are however some special problems associated with organic electrochemical production which were not so much of a problem in the chlorine and caustic industry. Sludge buildup within the electrolytic cell greatly reduces the current efficiency that the electrolytic cell can achieve and thereby reduces its commercial feasibility for organic electrochemical production. Sludge also necessitates more frequent maintenance resulting in more downtime for the production system than is desirable

SUMMARY OF THE INVENTION

It is therefore an object of the present invention to provide an electrolytic cell which is capable of obtaining a good current efficiency while reducing sludge buildup so as to reduce downtime caused by repeated maintenance.

It is another object of the present invention to provide an electrolytic cell which will utilize the technological advances in the industry to a greater advantage in organic electrochemical production.

These and other objects of the present invention, together with the advantages thereof over existing and prior art forms which will become apparent to those skilled in the art from the detailed disclosure of the present invention as set forth hereinbelow, are accomplished by the improvements herein shown, described and claimed.

It has been found that an electrolytic cell consists of: at least two end plates; a first electrode in sealing engagement with one of the end plates; a first electrode compartment frame in sealing engagement with the first electrode; at least two channels within opposing ends of the first electrode compartment frame to distribute an electrolyte solution evenly across the first electrode surface; at least one passageway communicating with each channel to circulate electrolyte solution; a planar separator in sealing engagement with the first electrode compartment frame; a second electrode compartment frame containing inlet and outlet ports for circulation of electrolyte solution and sealingly engaged with the planar separator; a second electrode element contained within the confines of the second electrode compartment frame; and means for impressing an electric current between the first electrode and the second electrode element.

One preferred embodiment of the subject electrolytic cell is shown by way of example in the accompanying drawings without attempting to show all of the various forms and modifications in which the invention might be embodied; the invention being measured by the appended claims and not by the details of this specification.

DESCRIPTION OF THE PREFERRED EMBODIMENT

Figure 1:
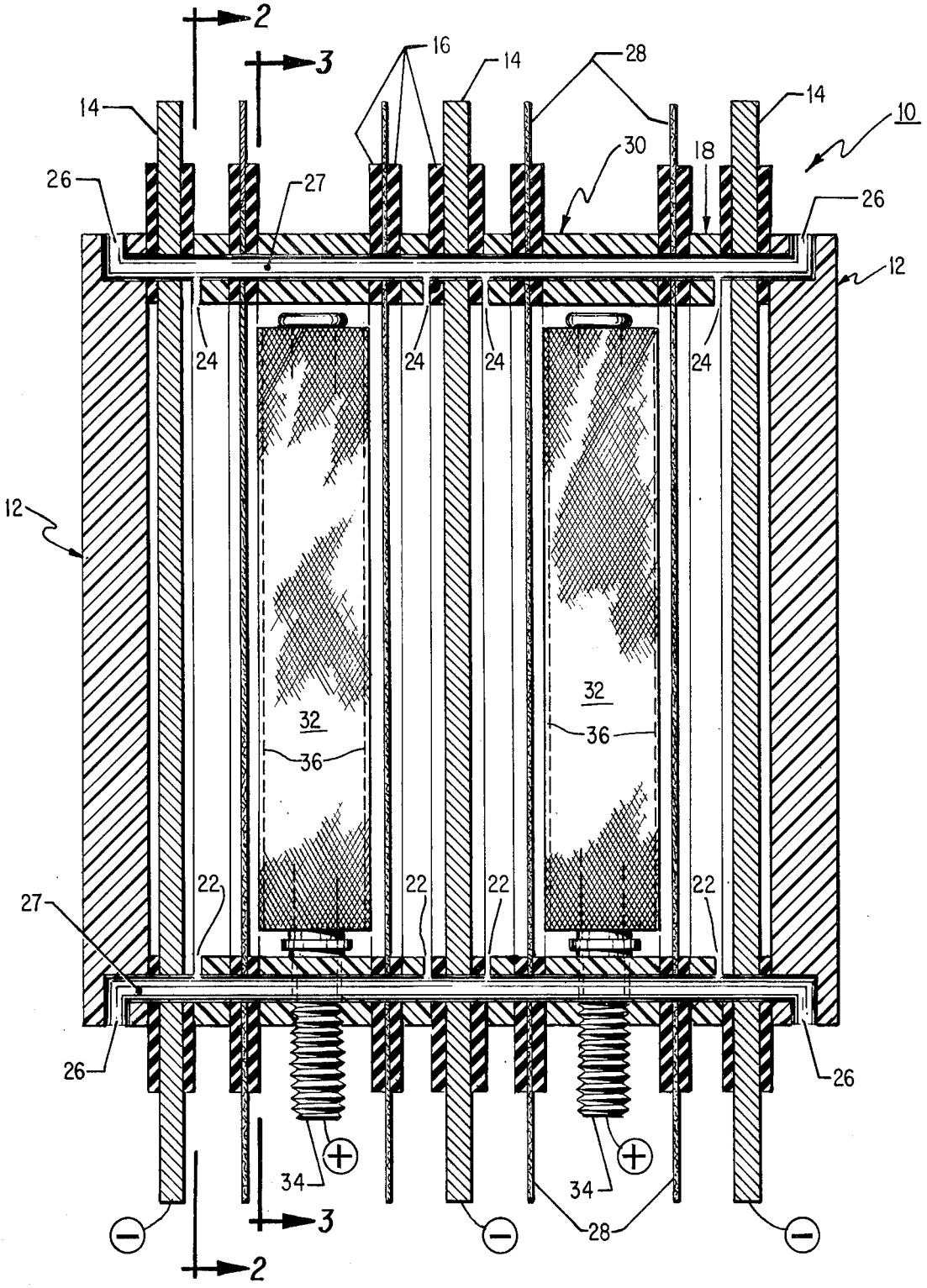
FIG. 1 is a side section view of an electrolytic cell according to the concepts of the present invention.

Referring to FIG. 1 of the drawings numeral 10 generally refers to an electrolytic cell according to the concepts of the present invention. Electrolytic cell 10 as shown in FIG. 1 would have environmental structure in the form of a press to maintain the components of the electrolytic cell 10 in tight and sealing engagement. The details of this environmental structure have not been shown for ease of illustrating the concepts of the present invention.

It can be observed in FIG. 1 that there are several repeating units within the electrolytic cell 10. Any number of these units may be combined to make a cell of larger capacity if so desired. In each case however, the cell must have a minimum of two end plates 12 so that the cell may be firmly supported by the surrounding environmental structure to maintain the components of the cell in sealing engagement. If so desired more than two end plates 12 can be used so as to combine more than one type of electrolytic cell in a surrounding press structure or so that electrolyte flow can be insured at a constant velocity throughout the cell compartments in the case of a large cell structure. The end plates 12 can be made of any substance which is generally resistant to the electrolyte solution being used in the electrolyte cell 10. Examples of satisfactory materials are polyvinyl chloride and polypropylene.

The electrolytic cell 10 has a first electrode 14 which as seen in FIG. 1, is being used as the cathode. The first electrode 14 or the cathode in this case, may be constructed of any conventional electrically conductive material resistant to the electrolyte solution used within the cell such as iron, mild steel, stainless steel, titanium, nickel or chemical lead. A suitable material for use in an organic electrochemical reaction was found to be chemical lead.

As seen in FIG. 1, the first electrode 14 is spaced from the end plate 12 by means of gasketing material 16. Such gasketing material 16 can be used throughout the cell to space each of the components and must be chemically resistant to the electrolyte solution being used within the electrolyte cell 10. An excellent choice for use in an organic electrochemical cell is neoprene since it has good chemical resistivities and also the compressibility necessary to provide a sealing engagement between the various components of the cell upon applying a relatively small pressure on each of the end plates 12.

The first electrode 14 is larger in size than the other cell components to afford an easily accessible connecting point for the negative terminal of a power source not shown herein. The electrical connection of the first electrodes 14 can be accomplished with busbars covering a large part of the surface of the extending portions of the first electrode 14 to provide the greatest electrical conducting surface possible. Also the first electrode 14 or cathode is generally planar such that in the central portions of the electrolyte cell 10, both sides of the first electrode 14 will be used in an electrolytic reaction to provide a greater use of each electrode within the cell 10.

Backed up to each side of the respective first electrodes 14 which are being used for an electrolytic reaction are first electrode compartment frames 18. First electrode compartment frames 18 are spaced away from the first electrodes 14 by gasketing 16 cut to engage only the exterior edge to allow flow of electrolyte solution into the cathode compartment.

Figure 2:
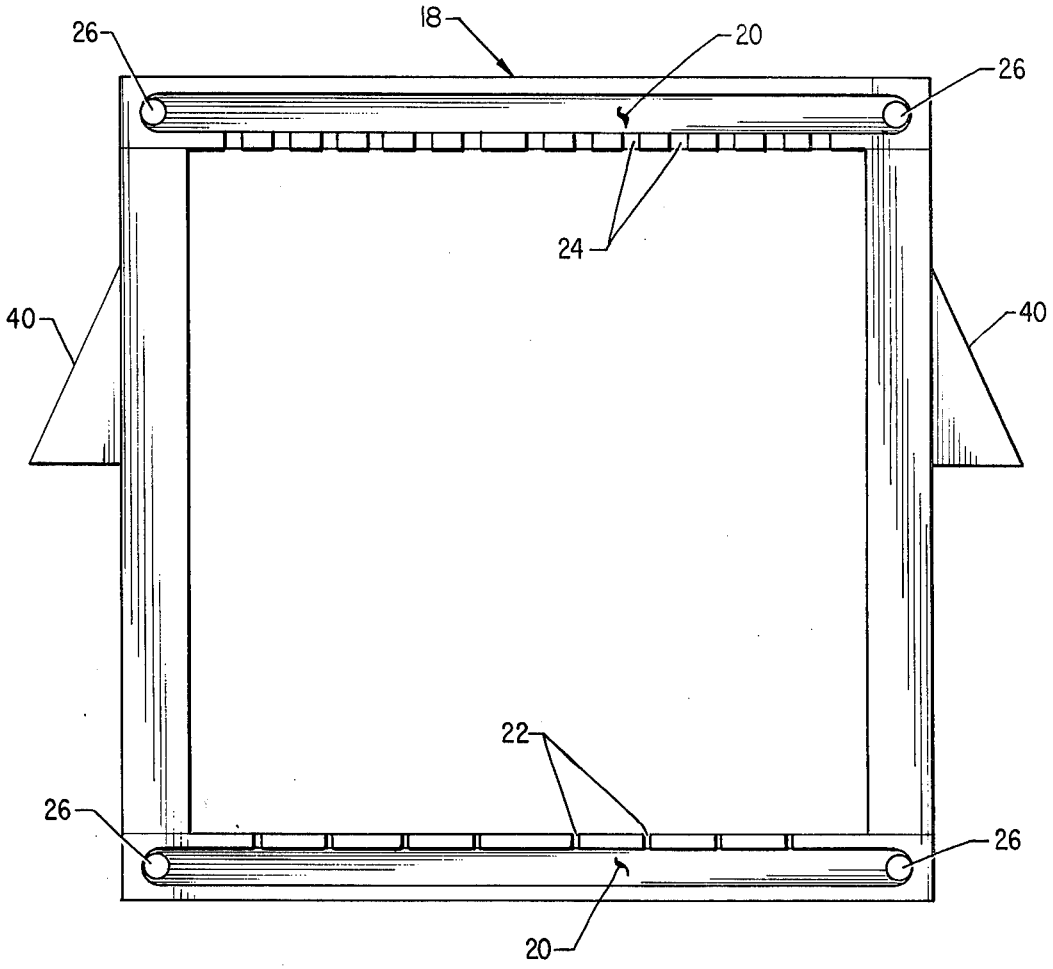
FIG. 2 is an elevation view of the first electrode compartment frame taken substantially along the line 2—2 of FIG. 1.

In FIG. 2, an elevation view of the first electrode compartment frame 18, it can be seen that there are two channels 20 milled through two opposing ends of the first electrode compartment frame 18 having a series of narrow slots 22 in the interior edge of one channel 20 of the first electrode compartment frame 18 and much larger slots 24 in the interior edge of the other channel 20. Channels 20 provide a means for even distribution and flow of an electrolyte solution within the desired compartment of the electrolytic cell 10. Due to the gasketing 16 which is placed between the first electrode compartment frame 18 and the first electrode 14, an opening is provided by which the electrolyte solution may flow into the cathode compartment. The slots 22 and 24 provide additional open space into and out of the cathode compartment in close alignment with the first electrode 14 plate surface. The first electrode 14 and first electrode compartment frame 18 could be used as the cathode, anode or both depending on the desired use of the electrolytic cell 10 for cathodic, anodic or simultaneous cathodic and anodic production reactions to be performed. These components can very easily be rearranged to build a cell for many different types of reactions. The first electrode compartment frame 18 like end plates 12 may be made of polyvinyl chloride or polypropylene.

To supply the channels 20, each component has apertures 26 which match those of the other components when assembled into an electrolytic cell forming a passageway 27 to communicate with the electrolyte solution reservoir not shown. Apertures 26 are transverse to the plane of the component in each component and in the gasketing associated therewith to form the even bored passageway 27 through the length of the electrolytic cell 10. The conditions for the operation of the electrolytic cell 10 for an electrochemical process will generally dictate the number of these passageways 27 required in order to yield even flow and distribution of the electrolyte solution within the electrolytic cell 10. The end plates 12 apertures 26 may be bored to provide a convenient means to connect a source of the electrolyte solution to the end plates 12. This can be as shown in FIG. 1 with a 90° bore to provide an opening on a side or the bottom of the electrolytic cell 10 or it could be straight as in the other sections of the cell to provide openings at the ends of the electrolyte cell 10.

For a particular organic electrochemical reaction it may be desirable to have sections of the cell blocked off or to increase the flow pattern within the passageways 27 by adding additional end plates 12 in the central portions of the cell either with no apertures 26 to provide an end block for the passageways 27 or with a T-aperture 26 so as to provide additional input for the electrolyte solution to increase the flow in a given area. Slots 22 in channel 20 to the interior of the electrolytic cell provide additional open area to enhance the jetting action of the electrolyte solution across the first electrode 14 surface to remove any sludge buildup within the cell and to prevent additional sludge buildup. Slots 24 will generally be two to four times as wide as slots 22 to provide a more open takeoff such that particles of sludge dislodged from within the cell will flow through slots 24 and channel 20 into the electrolyte solution reservoir where such particles may settle to the bottom thereof instead of clogging the working components of the electrolytic cell 10. Slots 24 also allow the release of any backpressure from within the electrolytic cell 10 which may build up during the operation of the cell 10. Generally if a bottom and top arrangement for channels 20 is used, the bottom will be the input feed and the top will be the takeoff return to the electrolyte reservoir.

In FIG. 1 this arrangement is used to circulate a catholyte solution within the cathode compartment of the electrolytic cell 10 but this system may just as easily be used to provide an anolyte solution circulation system in the event both a cathodic and anodic reaction might be utilized for production purposes within the electrolytic cell 10. This might be accomplished by having channels 20 on the top and bottom of the cathode compartment and additional channels 20 along the sides of the anode compartment.

The first electrode compartment frame 18 is backed up with gasketing 16 upon which a planar separator 28 may be placed. The planar separator 28 may be made of any of the conventional material for use in electrochemical cells such as the asbestos diaphragm or membrane materials made of polymeric substances as called for by the conditions of the particular reaction to be performed.

One type of membrane material which can be used in the present invention is a thin film of fluorinated copolymer having pendent sulfonic acid groups. The fluorinated copolymer is derived from monomers of the formula $$CF_2 = CF\text{-}(R)_n SO_3F \quad (1)$$

in which the pendent $-SO_2F$ groups are converted to $-SO_3H$ groups, and monomers of the formula $$CF_2 = Cxx^1 \quad (2)$$

wherein R represents the group $$-\underset{}{\overset{R^1}{\overset{|}{C}}}F-CF_2-O-(CFY-CF_2O)_m$$

in which the $R^1$ is fluorine or fluoroalkyl of 1 thru 10 carbon atoms; Y is fluorine or trifluoromethyl; $m$ is 1, 2 or 3; $n$ is 0 or 1; $x$ is fluorine, chlorine or trifluoromethyl; and $x^1$ is $x$ or $CF_3-(CF_2)_a0-$ wherein a is 0 or an integer from 1 to 5.

This results in copolymers having the repeating structural units $$\begin{array}{l} -CF_2-CF- \\ \quad\quad\;\; | \\ \quad\quad (R)_n \\ \quad\quad\;\; | \\ \quad\quad SO_3H \end{array} \quad (3)$$

and $$TI-CF_2-Cxx^1- \quad (4)$$

In the copolymer there should be sufficient repeating units according to formula (3) above, to provide an $-SO_3H$ equivalent weight of about 1000 to 1400. Materials having a water absorption of about 25 percent or greater are preferred since higher cell voltages at any given current density are required for materials having less water absorption. Similarly, materials having a film thickness (unlaminated) of about 8 mils or more, require higher cell voltages resulting in a lower power efficiency.

Typically, because of large surface areas of the membrane in commercial cells, the substrate film material will be laminated to and impregnated into a hydraulically permeable, electrically non-conductive, inert, reinforcing member, such as a woven or non-woven fabric made of fibers of asbestos, glass, TEFLON, or the like. In film/fabric composite materials, it is preferred that the laminating produce an unbroken surface of the film resin on at least one side of the fabric to prevent leakage through the substrate film material.

Membranes of this type are further described in the following patents: U.S. Pat. Nos. 3,041,317; 3,282,875; 3,560,568; 3,624,053; 3,718,627; and British Pat. No. 1,184,321. Substrate materials as aforedescribed are available from E. I. duPont deNemours and Co. under the trademark NAFION.

A second type of membrane material has a backbone chain of copolymers of tetrafluoroethylene and hexafluoropropylene and grafted onto this backbone a 50-50 mixture of styrene and alpha methyl styrene. This type of membrane while having different pendent groups has a fluorinated backbone chain so that the chemical resistivities are reasonably high.

Another type of membrane material which would have application in cells with less caustic conditions for example electrochemical production of organic compounds, would be polymer substances having pendent sulfonic acid groups wherein the polymeric backbone is derived from the polymerization of a polyvinyl aromatic component with a monovinyl aromatic component in an inorganic solvent under conditions which prevent solvent evaporation which result in a generally copolymeric substance although a 100 percent polyvinyl aromatic compound may be prepared which is satisfactory.

The polyvinyl aromatic component may be chosen from the group including: divinyl benzenes, divinyl toluenes, divinyl napthalenes, divinyl diphenyls, divinyl-phenyl vinyl ethers, the substituted alkyl derivatives thereof such as dimethyl divinyl benzenes and similar polymerizable aromatic compounds which are polyfunctional with respect to vinyl groups.

The monovinyl aromatic component which will generally be the impurities present in commercial grades of polyvinyl aromatic compounds include: styrene, isomeric vinyl toluenes, vinyl napthalenes, vinyl ethyl benzenes, vinyl chlorobenzenes, vinyl sylenes, and alpha substituted alkyl derivatives thereof, such as alpha methyl vinyl benzene. In cases where high-purity polyvinyl aromatic compounds are used, it may be desirable to add monovinyl aromatic compounds so that the polyvinyl aromatic compound will constitute 30 to 80 mole percent of polymerizable material.

Suitable solvents in which the polymerizable material may be dissolved prior to polymerization should be inert to the polymerization (in that they do not react chemically with the monomers or polymer), should also possess a boiling point greater than 60° C, and should be miscible with the sulfonation medium.

Polymerization is effected by any of the well known expedients for instance, heat, pressure, and catalytic accelerators, and is continued until an insoluble, infusible gel is formed substantially throughout the volume of solution. The resulting gel structures are then sulfonated in a solvated condition and to such an extent that there are not more than four equivalents of sulfonic acid groups formed for each mole of polyvinyl aromatic compound in the polymer and not less than one equivalent of sulfonic acid groups formed for each ten mole of poly- and monovinyl aromatic compound in the polymer. As with the NAFION type material these materials may requre reinforcing of similar materials.

Substrate film materials of this type are further described in the following patents: U.S. Pat. Nos. 2,731,411 and 3,887,499. These materials are available from Ionics, Inc. under the trademark IONICS CR6.

Various means of improving these substrate materials have been sought, one of the most effective of which is the surface chemical treatment of the substrate itself. Generally these treatments consist of reacting the sulfonyl fluoride pendent groups with substances which will yield less polar bonding and thereby absorb fewer water molecules by hydrogen bonding. This has a tendency to narrow the pore openings through which the cations travel so that less water of hydration is transmitted with the cations through the membrane. An example of this would be to react the ethylene diamine with the pendent groups to tie two of the pendent groups together by two nitrogen atoms in the ethylene diamine. Generally, in a film thickness of 7 mils, the surface treatment will be done to a depth of approximately 2 mils on one side of the film by means of a time to the reaction procedure. This will result in good electrical conductivity and cation transmission with less hydroxide ion and associated water reverse migration.

Figure 3:
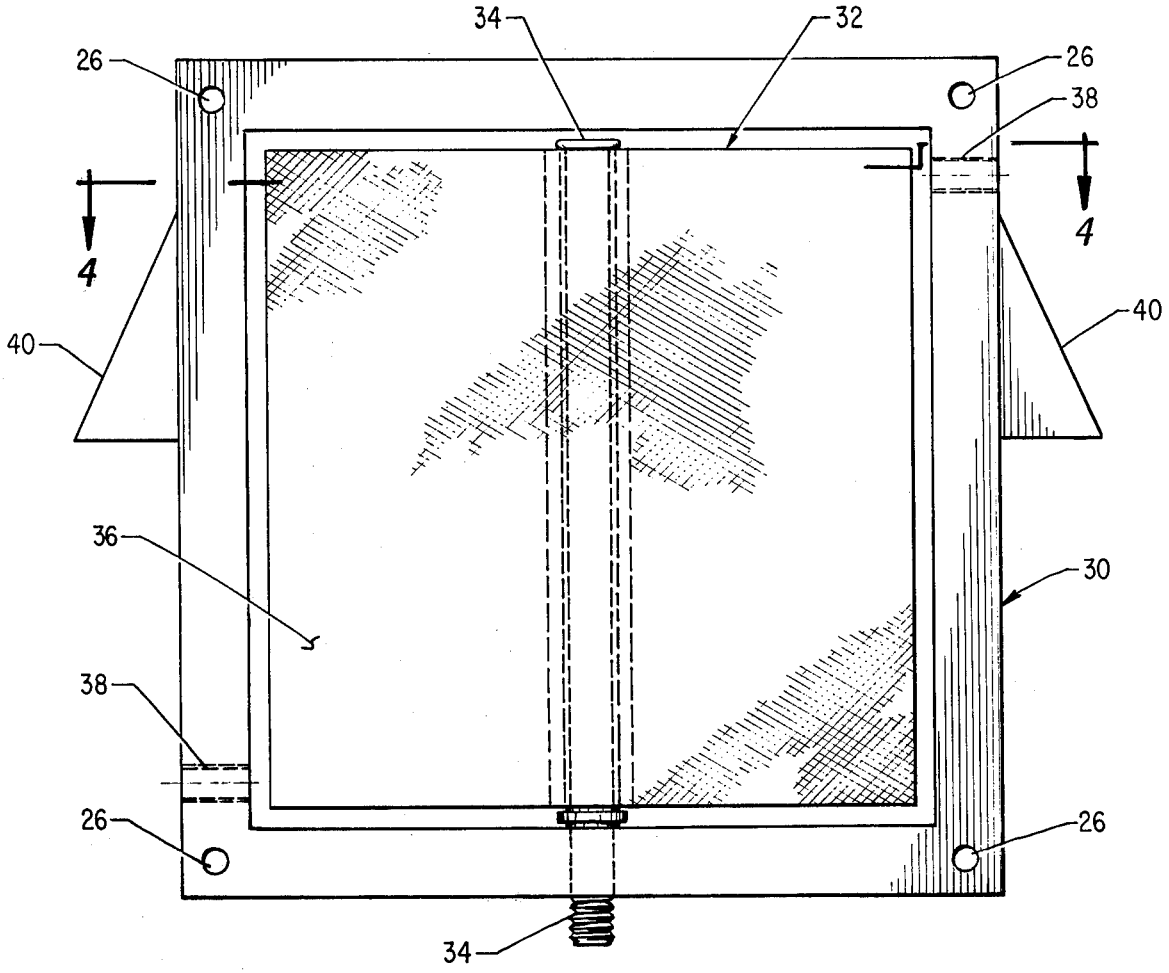
FIG. 3 is an elevation view of the second electrode compartment frame containing the second electrode element taken substantially along line 3—3 of FIG. 1.
Figure 4:
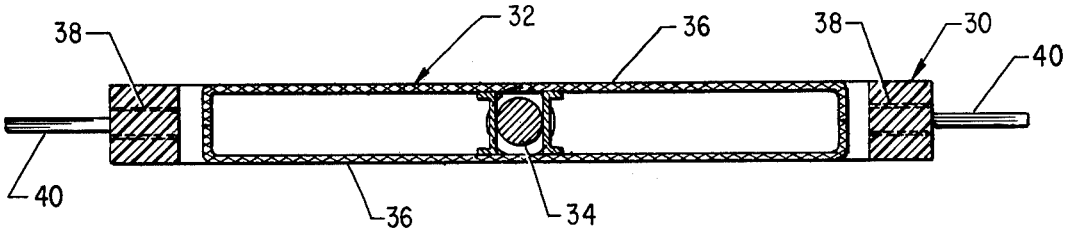
FIG. 4 is a top section view of the second electrode element taken substantially along line 4—4 of FIG. 3.

Backed up to the planar separator 28 with gasketing 16 is a second electrode compartment frame 30 which contains a second electrode element 32. The second electrode element 32, being used as an anode in FIG. 1, has a central power distributor bar 34 extending through the second electrode compartment frame 30 as seen in FIGS. 1 and 3 for connecting the positive terminal of a power source not shown to complete an electrical circuit by which an electrolyzing current may be impressed upon the electrolytic cell 10. The central power distributor bar 34 is mechanically and electrically attached to two sheets of planar foraminous 36 which are maintained in spaced relation to the interior walls of the second electrode compartment frame 30 as seen in FIG. 4. The foraminous material 36 will generally be an electrically conductive electrocatalytically active material, resistant to the electrolyte contained within the cell such as a dimensionally stable anode. Such anode materials are well known and used in the industry and include a base substrate material generally of a valve metal like titanium or tantalum carrying on the surface on oxide coating of tantalum and iridium or a combination of a tin/antimony oxide coating covered with manganese dioxide or lead dioxide in the case of acid mediums. See, for example, U.S. Pats. Nos. 3,117,023; 3,632,498; 3,840,443 and 3,846,273. The conditions of operation for the desired reaction will generally dictate the use of a specific type of anode for that purpose.

The second electrode compartment frame 30 has apertures 26 in the respective four corners to match those of the other components to form the electrolyte solution passageway and if only a cathodic production reaction is being performed within the cell, the circulation system for the anolyte can very simply be two bores 38 at opposing corners of the second electrode compartment frame 30. If an anodic production section is being performed in the electrolytic cell 10 described, a circulation system similar to that used for the cathode compartment may be employed. The second electrode compartment frame 30 may be made of materials similar to the end plates 12 such as polyvinyl chloride or polypropylene.

For convenience of aligning many components to assemble the electrolytic cell 10 within the environmental press structure support arms 40 are provided on each component to allow each to be conveniently hung on parallel rails which are insulated from the electrodes for final assembly of a given electrolytic cell 10 in precise alignment. As many of these repeating units as may be desired can be combined to build a large capacity electrolytic cell 10 to meet production requirements, or a number of cells can be combined within one press by use of several end plates 12. A sequential electrolytic reaction system may be designed this way. It can be seen that the relatively planar components allow the distance between the electrodes to be kept to a minimum thereby increasing the current efficienty by lowering the voltage drop across the cell components for a given current density. Furthermore, this type of cell design greatly facilitates assembly and disassembly of an electrolytic cell of any size according to the concepts of the present invention in building block like manner.

The electrolytic cell 10 as shown in the drawings herein is especially suitable for the production of pinacols by electrolytically reducing organic carbonyl compounds at the cathode. In this process a fine sludge formed in the cathode compartment is prevented from falling into the lower section and causing a blockage of the electrolyte solution flow by the jetting action from the lower channel 20 and slots 22. It was found that a flowrate of approximately 17 feet per second or more was adequate to keep the area clear and provide excellent circulation of the catholyte solution within the cathode compartment. The sludge formed in this process is then allowed to settle to the bottom of the catholyte solution reservoir tank where it is unobtrusive to the operation of the electrolytic cell 10 for a production of pinacols. Numerous other types of organic electrochemical reactions may be performed within the electrolytic cell 10 by utilizing the concepts of the present invention to adapt the cell components to the given conditions for the desired electrochemical reaction.

Thus it should be apparent from the foregoing description of the preferred embodiment that the electrolytic cell herein shown and described accomplishes the objects of the invention and solves the problems attendant electrolytic cells for use in organic electrochemical production as heretofore described.

What is claimed is:

1. An electrolytic cell comprising: at least two end plates; a first electrode in sealing engagement with one of said end plates; a first electrode compartment frame in sealing engagement with said first electrode; at least two channels within opposing ends of said first electrode compartment frame of distribute an electrolyte solution evenly across said first electrode entire surface; slots milled transverse to the axis of each of said channels to provide further opening into the interior of said first electrode compartment frame to enhance the jetting action of the electrolyte across said first electrode; a planar separator in sealing engagement with said first electrode compartment; a second electrode compartment frame containing inlet and outlet ports for circulation of electrolyte solution and sealingly engaged with said planar separator; a second electrode element contained with the confines of said second electrode compartment frame; and means for impressing an electric current between said first electrode and said second electrode element.

2. An electrolytic cell according to claim 1 further comprising gasketing for sealingly engaging each of the components of the electrolytic cell.

3. An electrolytic cell according to claim 1 wherein said first electrode has a larger surface area than the remaining components of the electrolytic cell such that upon assembly of the electrolytic cell ample space is provided for electrical connection of busbars to said first electrode.

4. An electrolytic cell according to claim 1 wherein each component of the electrolytic cell has at least two support arms thereon so that each component may be supported by two parallel bars for easy assembly of the electrolytic cell.

5. An electrolytic cell according to claim 1 wherein said second electrode element further comprises: a central power distributor bar extending through said second electrode compartment frame for electrical connection thereto; and two coplanar sheets of foraminous material connected to said central power distributor bar so as to be maintained in spaced relation to the interior walls of said second electrode compartment frame.

6. An electrolytic cell according to claim 1 wherein said planar separator is a hydraulically impermeable cationexchange membrane consisting essentially of a film of copolymer having the repeating structural units of the formula:

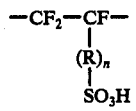

(1)

and $$-CF_2-Cxx^1- \quad (2)$$

wherein R represents the group

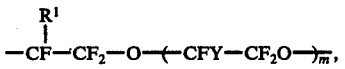

in which $R^1$ is fluorine or perfluoroalkyl of 1 to 10 carbon atoms; Y is fluorine or trifluoromethyl; $m$ is 1, 2 or 3; $n$ is 0 or 1; $x$ is fluorine, chlorine, or trifluoromethyl; $x^1$ is $x$ or $CF_3$— —$CF_2$—$_a$O—; $a$ is 0 or integer from 1 to 5; and the units of the formula 1 being present in an amount to provide a copolymer having a —$SO_3H$ equivalent weight in the range of 1,000 to 1,400.

* * * * *